United States Patent [19]

Ishigami

[11] Patent Number: 4,867,582

[45] Date of Patent: Sep. 19, 1989

[54] PRINTING APPARATUS

[75] Inventor: Michifumi Ishigami, Nagoya, Japan

[73] Assignee: Brother Kogyo Kabushiki Kaisha, Japan

[21] Appl. No.: 301,799

[22] Filed: Jan. 25, 1989

Related U.S. Application Data

[63] Continuation of Ser. No. 81,870, Aug. 5, 1987, abandoned.

[30] Foreign Application Priority Data

Aug. 6, 1986 [JP] Japan ..... 61-184800

[51] Int. Cl.[4] ..... B41J 5/30; B41J 29/38

[52] U.S. Cl. ..... 400/70; 400/73; 400/674; 400/54

[58] Field of Search ..... 400/54, 70, 73, 279–282, 400/674, 679, 680, 691–693; 312/21–25; 360/79, 86, 97.01, 99.01, 137

[56] References Cited

U.S. PATENT DOCUMENTS

| | | | |
|---|---|---|---|
| 4,688,131 | 8/1987 | Noda et al. | 360/137 |
| 4,725,157 | 2/1988 | Nakai et al. | 400/680 |
| 4,750,063 | 6/1988 | Kumr et al. | 360/99 |

FOREIGN PATENT DOCUMENTS

| | | | |
|---|---|---|---|
| 93369 | 5/1984 | Japan | 400/70 |
| 141580 | 7/1985 | Japan | 400/679 |

OTHER PUBLICATIONS

I.B.M Technical Disclosure Bulletin vol. 28, No. 6, 11/1985, p. 2476, "Six—Point Hinge Mechanism".

I.B.M Technical Disclosure Bulletin, vol. 28, No. 8, 1/1986, p. 3409, "Cartridge Latch Mechanism".

I.B.M Technical Disclosure Bulletin, vol. 28, No. 9, 2/1986, p. 3877, "Dishette Drive Single Connector, Low Power Interface".

I.B.M Technical Disclosure Bulletin, vol 29, No. 9, 2/1987, p. 4117, "Bridge Assembly for Mounting Devices."

*Primary Examiner*—Edgar S. Burr

*Assistant Examiner*—Huong Q. Pham

*Attorney, Agent, or Firm*—Kane, Dalsimer, Sullivan, Kurucz, Levy, Eisele and Richard

[57] ABSTRACT

In a printing apparatus comprising a printing head unit reciprocatively movable along a platen within a frame, provided are a memory unit for storing printing data, and means for supporting the memory unit in such a manner that the memory unit is selectively positioned out of the frame or within a spacing formed inside the frame for reciprocative movement of the printing head.

12 Claims, 4 Drawing Sheets

PRINTING APPARATUS

RELATED APPLICATIONS

This is a continuation to application Ser. No. 081,870, filed Aug. 5, 1987, now abandoned.

BACKGROUND OF THE INVENTION

This invention relates to a printing apparatus such as a typewriter and an independent printer, and more particularly to a printing apparatus which is operated based upon printing data stored in a recording medium such as a floppy disc.

Conventionally, in order to store printing data prepared by operating the keys on, for instance, a typewriter onto a recording medium such as a floppy disc and to carry out the printing in accordance with the data stored in the recording medium, it has been necessary to dispose the external memory unit such as a disc drive unit side by side with the printing apparatus and connect therebetween with a cable and so on.

Under the above conditions, however, since the memory unit has been constructed as a separate unit from the printing apparatus, there have been problems since the system as a whole becomes bulky and accordingly a relatively large space is required to accommodate them during use thereof, it becomes difficult to handle during transportation thereof, and that the connection and disconnection of the cable are troublesome.

In this connection, there has been proposed a type of office typewriters where the memory unit is incorporated in the main body at the rear side thereof so that the memory unit may not with various operations of the printing mechanisms of the typewriter. In the case of such type apparatus, however, such problems have then arisen that the typewriter becomes voluminous due to the increase in the volume corresponding to the incorporated memory unit, and that, because the memory unit is located at the rear side of a main body, loading and unloading of the recording medium into and out of the memory unit are difficult.

SUMMARY OF THE INVENTION

It is therefore an object of the invention to provide an improved printing apparatus capable of eliminating such deficiencies as above described.

For this purspose, in accordance with the invention, there is provided a printing apparatus comprising a printing head unit reciprocatively movable along a platen within a frame, the improvement which comprises: a memory unit for storing printing data; and means for supporting said memory unit in such a manner that said memory unit is selectively positioned out of said frame or within a spacing formed inside said frame for reciprocative movement of said printing head.

In one embodiment of the invention, said apparatus further comprises a pair of guide bars arranged in parallel with said platen inside said frame for guiding the movement of said printing head unit, and said memory unit supporting means comprises a supporting member secured to said memory unit and slidably mounted on said pair of bars.

In a modified embodiment of the invention, said memory unit supporting means comprises a pair of bosses formed inside said frame for swingably supporting one side of said memory unit.

With the above constructed printing apparatus, the memory unit can, during nonuse of the printing apparatus, be kept at its storage position i.e., in the vacant space defined inside the frame for allowing the reciprocative movements of the printing head unit, whereby the printing apparatus as a whole is prevented from becoming large in size facilitating transportation and storage of the printing apparatus while incorporating the memory unit therein. During use of the printing apparatus, the memory unit is stuck into its position for use outside the frame of the printing apparatus, whereby the loading and unloading of a storage medium into and out of the memory unit is enabled to be easily performed from the front thereof.

DESCRIPTION OF THE ACCOMPANYING DRAWINGS

DESCRIPTION OF THE PREFERRED EMBODIMENT

Figure 1:
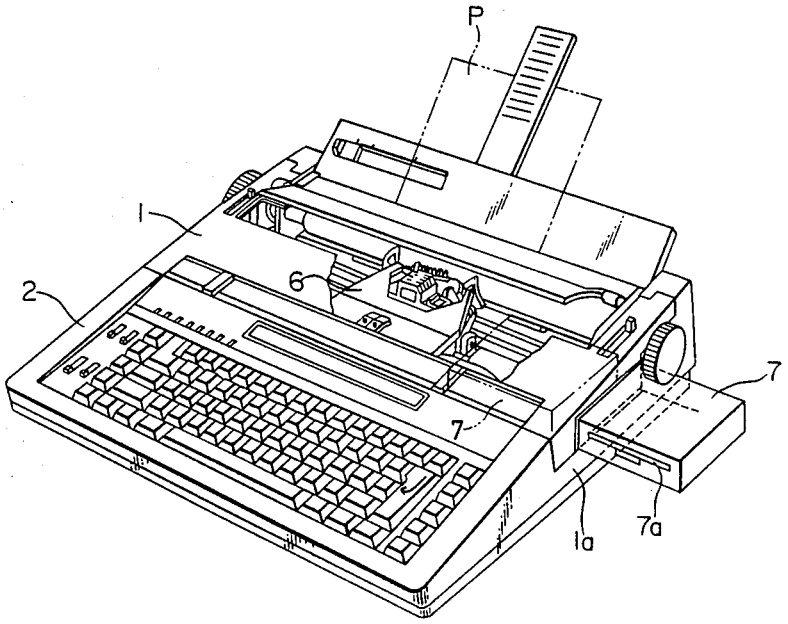
FIG. 1 is a perspective view of a typewriter embodying the invention.
Figure 2:
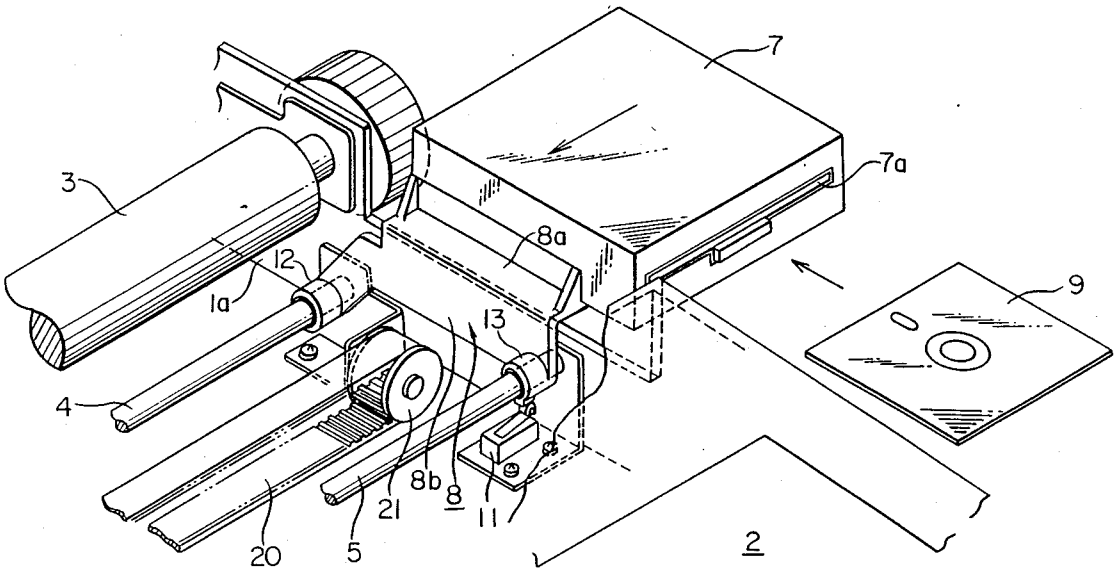
FIG. 2 is an enlarged perspective view of the memory unit and the related parts of the typewriter shown in FIG. 1.

FIG. 1 shows an electric typewriter embodying the invention, wherein a keyboard portion 2 with a large number of keys arranged thereon is provided at the front side thereof. At the rear side thereof, inside an openable cover plate 1, a rotatable platen 3 is arranged for supporting and guiding a printing paper P. In parallel with the platen 3, as illustrated in FIG. 2, a pair of guide bars 4 and 5 are extended with a predetermined interval for guiding a reciprocative movements of a printing head unit 6 in the axial direction of the platen 3. The printing head unit 6 is the conventional one which comprises a carriage, a daisy wheel, a hammer, a ribbon cassette and other parts. Arranged under the bars 4 and 5 is a timing belt 20 for moving the printing head unit 6 based upon the signals fed to a driving motor, not shown, connected to a driving gear 21.

At one end of the guide bars 4 and 5, as minutely illustrated in FIG. 2, an inverted L-shaped supporting plate 8 which supports a floppy disc drive unit 7 at the upper leg **8*a* thereof is slidably mounted by bridging the bar 4 and 5 at the vertical leg 8*b* thereof. When the plate 8 is positioned at the to extreme right as shown in FIGS. 1 and 2, the upper leg 8*a* of the plate 8 crosses over a body frame 1*a* and the floppy disc drive unit 7 is positioned completely out of the body frame 1*a* of the typewriter. In this connection, the body frame 1*a* is partly cut off to enable the passing-through of the floppy disc drive unit 7**.

The bar receiving portions 12 and 13 formed at the lower end of the vertical leg **8*b* of the plate 8 are made of rubber to generate a frictional force sufficient to prevent the unintentional sliding movement of the floppy disc drive unit 7** unless a manual force is applied thereto by an operator.

The floppy disk drive unit 7 supported by the plate 8 serves as an external memory unit capable of storing printing data prepared by operating the keys on the keyboard portion 2 of the typewriter. At the front surface of the unit 7 there is provided an opening **7*a* for inserting and taking out a floppy disk 9** which serves as a recording medium.

When a manual force is applied to the floppy disc drive unit 7 to move it in the leftward direction in FIGS. 1 and 2, the plate 8 starts to move along the bars 4 and 5 against the frictional force existing between the bars 4/5 and the bar receiving portions 12/13 and the floppy disc drive unit 7 can be completely accommodate inside the body frame 1*a* of the typewriter as illustrated in FIG. 1 by double-dotted lines.

Although the printing head unit 6 moves in almost the full range of the vacant space under the cover frame 1 while carrying out the printing operation, by defining a home position of the printing head unit 6 at or the left side of the position illustrated in FIG. 1, there remains space sufficient to accomodate the floppy disc drive unit 7 inside the body frame 1*a* of the typewriter. On the other hand, during the printing operation, the floppy disc drive unit 7 is taken out of the typewriter for floppy disc treatments so that is does not bar the free movement of the printing head unit 6. In order to assure this conditon, a mechanical switch 11 is arranged in such a manner that the bar receiving portion 13 of the plate 8 contacts the switch 11 to turn it on when the plate 8 reached to the extreme right position thereof, i.e., when the floppy disc drive unit 7 is completely taken out of the body frame 1*a*. This mechanical switch 11 is electrically connected between a power supply source, not shown, and a main driving circuit, also not shown, for driving various mechanisms equipped to the typewriter so that, even if the power is supplied to the typewriter, the printing operation can not be carried out and therefore the printing head unit 6 can not move along the bars 4 and 5.

With the above constructed electric typewriter, during preparation of printing data, the floppy disk drive unit 7 is positioned out of the main body 1*a* of the typewriter and the opening 7*a* for the floppy disc 9 is positioned just adjacent the keyboard portion 2 of the typewriter so that the treatments of the floppy disc 9 becomes considerably easy. Further, the operations of various mechanisms equipped to the typewriter including the movements of the printing head unit 6 are, of course, not disturbed at all by the existence of the floppy disc drive unit 7. On the contrary, the floppy disc drive unit 7 can be completely accomodated inside the body frame 1*a* and under the openable cover frame 1 during nonuse of the typewriter, which makes it easy to transport it to other places or so.

Figure 3:
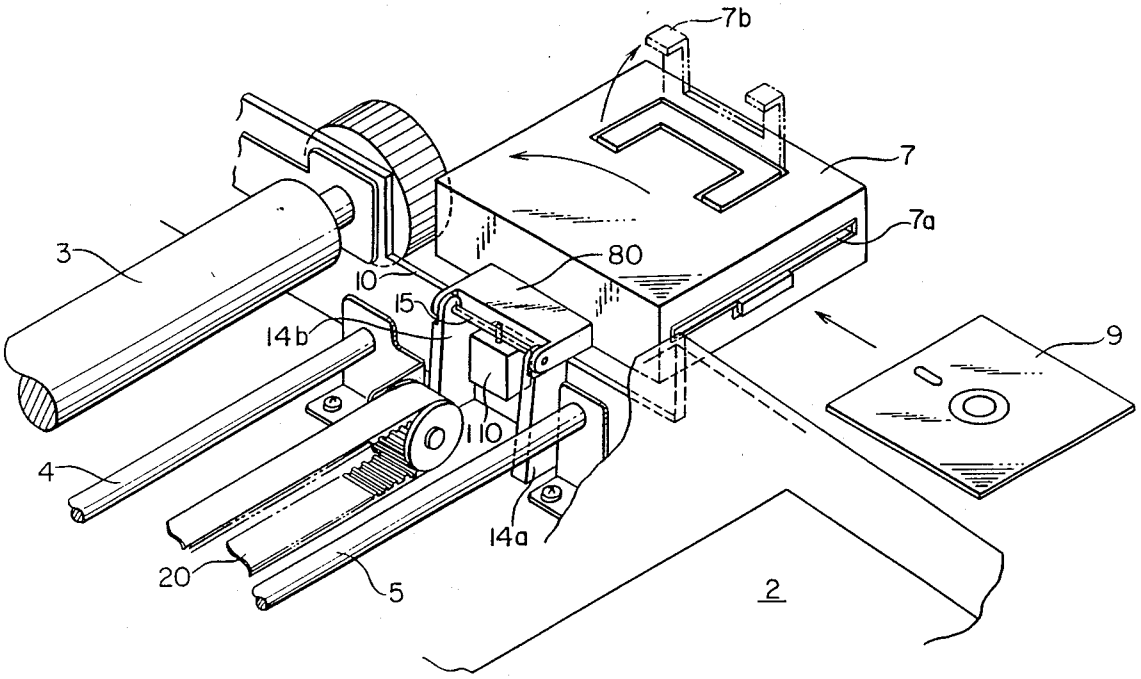
FIG. 3 is an enlarged perspective view of the memory unit and the related parts of the modified typewriter embodying the invention.
Figure 4:
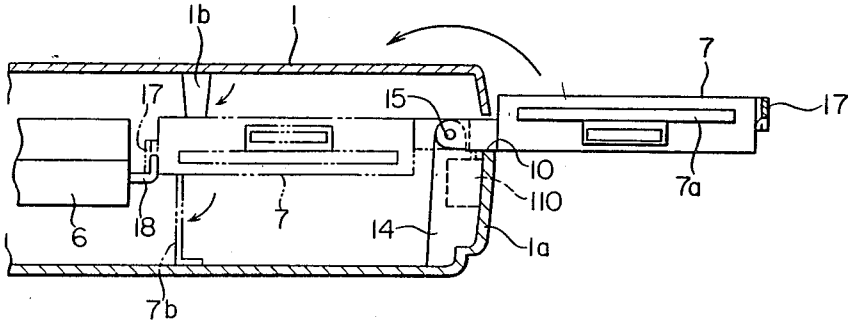
FIG. 4 is a partially sectional view of the memory unit and the related parts shown in FIG. 3.

FIGS. 3 and 4 show a modified embodiment of the invention. In this embodiment, the floppy disk drive unit 7 is pivotaly supported at one side thereof on a pair of bosses 14*a* and 14*b* formed inside the body frame 1*a*. More particularly, a connecting member 80 protruded on one side of the floppy disc drive unit 7 is secured to a pivot shaft 15 which is rotatably supported by the pair of bosses 14*a* and 14*b*.

With this modification, the floppy disc drive unit 7 is swingable between its operating position and its storage position about the pivot shaft 15. When it is turned to its operating position, i.e. the position illustrated in FIG. 3, the connecting member 80 seats the upper edge 10 of the body frame 1*a* to hold the floppy disc drive unit 7 at that position. On the contrary, when it is turned to its storage position, i.e., the position illustrated in FIG. 4 by double-dotted lines, a supporting leg 7*b* retractably arranged on the upper side of the floppy disc drive unit 7 is manually extended so as to support the unit 7. Further, another leg 1*b* retractably arranged on the inner surface of the cover frame 1 is extended to prevent the unintentional swinging of the unit 7. Additionally, at the side of the floppy disc drive unit 7 opposite to the side where the connecting member 80 is provided, a channel-shaped hook member 17 may be formed to engage with a hook receiving member 18 correspondingly formed at one side of the printing head unit 6 when the floppy disk drive unit 7 is placed at its storage position, as illustrated in FIG. 4. When adopting this hook mechanism, the home position of the printing head unit 6 must of course be so determined as to be adjacent the accomodated unit 7. With these arrangements of the supporting mechanism, the floppy disc drive unit 7 can be stably accomodated inside the main body 1*a* and under the cover frame 1 during nonuse of the typewriter.

In the above modified embodiment, when turning the floppy disc drive unit 7 between its operating and storage positions, the cover frame 1 is maintained to be open. Further, a mechanical switch 110 functions the same as the mechanical switch 11 of the first embodiment is arranged to be turned on when the connecting member 80 seats the upper edge 10 of the body frame 1*a*.

Thus, also with the above modified embodiment, during preparation of printing data, the floppy disk drive unit 7 is positioned out of the main body 1*a* of the typewriter and the opening 7*a* for the floppy disc 9 is positioned just adjacent the keyboard portion 2 of the typewriter so that the treatment of the floppy disc 9 becomes quite easy. Further, the operations of various mechanisms equipped to the typewriter including the movements of the printing head unit 6 are, of course, not disturbed at all by the existence of the floppy disc drive unit 7. On the contrary, the floppy disc drive unit 7 can be completely accomodated inside the body frame 1*a* and under the openable cover frame 1 during nonuse of the typewriter, which makes it easy to transport it to other places.

Although the foregoing embodiments are all for the electric typewriters, the present invention may be applied to other printing apparatuses which can be operated in accordance with the printing data stored in the external recording media such as magnetic disks, magnetic tapes, optical disks and so on.

What is claimed is:

1. A printing apparatus comprising:

a frame having opposed sides;

a platen disposed within said frame extending from side to side;

a print head unit reciprocatively movable along said platen;

guide bar means for guiding the movement of said print head positioned within said frame and arranged in parallel with said platen;

a memory unit for storing printing data; and, a supporting member having one end secured to said memory unit and an opposite end mounted so as to render said memory unit shiftable between a first position wherein said memory unit is disposed entirely within said frame and a second position wherein said memory unit extends beyond a side of said frame, said supporting member opposite end being slidably mounted to said guide bar means.

2. The invention in accordance with claim 1 wherein said guide bar means comprises a pair of parallel guide bars extending along said platen in parallel therewith and said supporting member opposite end slidably bridges said guide bars.

3. The apparatus according to claim 2 wherein said supporting member comprises an inverted L shaped plate, an upper leg of said plate being secured to said memory unit while a vertical leg of said plate being slidably mounted on said guide bars.

4. The apparatus according to claim 3 wherein said vertical leg of the supporting member is provided with a pair of portions to contact said guide bars respectively, and at least one of said portions is formed of rubber so as to generate a frictional force between said one of portions and one of said bars to prevent unintentional sliding of said supporting member relative to said bars.

5. The apparatus according to claim 2 which further comprises means for confirming that said memory unit is positioned out of said frame.

6. The apparatus according to claim 5 wherein said confirming means comprises a mechanical switch operated by said supporting member when said memory unit is positioned out of said frame.

7. The invention in accordance with claim 2 wherein said hook receiving member is provided on said printing head unit.

8. A printing apparatus comprising:

a frame having opposed sides;

a platen disposed within said frame extending from side to side;

a print head unit reciprocatively movable along said platen, said print head unit being provided with one of a hook member and a hook receiving member;

a memory unit for storing printing data, said memory unit being provided with the other one of said hook member and receiving member; and, a supporting member formed within said frame for swingably supporting one side of said memory unit so as to render said memory unit shiftable between a first position wherein said memory unit is disposed entirely within said frame and a second position wherein said memory unit extends beyond a side of said frame, wherein said hook member is engaged with said hook receiving member when said memory unit is in said first position so as to hold said memory unit within said frame.

9. The apparatus according to claim 8 which further comprises confirming means for confirming that said memory unit is positioned out of said frame.

10. The apparatus according to claim 8 wherein said confirming means comprises a mechanical switch operated by said supporting member when said memory unit is positioned out of said frame.

11. The apparatus in accordance with claim 10 wherein said supporting member comprises a pair of bosses formed inside said frame for swingably supporting one side of said memory unit, and wherein said mechanical switch is arranged between said pair of bosses.

12. A printing apparatus comprising:

a frame having opposed sides;

a platen disposed within said frame extending from side to side;

a print head unit reciprocatively movable along said platen;

a memory unit for storing printing data; and, a supporting member formed within said frame so as to render said memory unit shiftable between a first position wherein said memory unit is disposed entirely within said frame and a second position wherein said memory unit extends beyond a side of said frame;

a hook member provided on said memory unit; and, a hook receiving member provided within said frame for receiving said hook member when said memory unit is in said first position wherein said memory unit is provided with a first retractable member on an outer surface thereof and said frame is provided with a second retractable member on an inner surface thereof, said first and second retractable members, when extended, holding said memory unit within said frame when said memory unit is in said first position.

* * * * *